US010415281B2

(12) United States Patent
Enos et al.

(10) Patent No.: US 10,415,281 B2
(45) Date of Patent: Sep. 17, 2019

(54) PORTABLE DOOR LOCKING SYSTEM

(71) Applicants: Gregory Enos, Walnut Creek, CA (US); Paul Wang, Walnut Creek, CA (US)

(72) Inventors: Gregory Enos, Walnut Creek, CA (US); Paul Wang, Walnut Creek, CA (US)

( * ) Notice: Subject to any disclaimer, the term of this patent is extended or adjusted under 35 U.S.C. 154(b) by 84 days.

(21) Appl. No.: 15/671,931

(22) Filed: Aug. 8, 2017

(65) Prior Publication Data

US 2019/0048632 A1 Feb. 14, 2019

(51) Int. Cl.

| | |
|---|---|
| ***E05C 19/18*** | (2006.01) |
| ***E05B 35/00*** | (2006.01) |
| *E05B 47/00* | (2006.01) |
| *E05B 63/00* | (2006.01) |

(52) U.S. Cl.

CPC ..... *E05C 19/184* (2013.01); *E05B 35/008* (2013.01); *E05B 47/0012* (2013.01); *E05B 63/0008* (2013.01); *E05B 2047/0094* (2013.01)

(58) Field of Classification Search

CPC ..... E05C 19/184; E05B 35/008
USPC ..... 16/250, 82, 374; 292/288
See application file for complete search history.

(56) References Cited

U.S. PATENT DOCUMENTS 314,105 A * 3/1885 Carnes ..... E05D 11/1007 16/223
485,613 A * 11/1892 Deane ..... E05D 11/1007 16/353
2,201,594 A * 5/1940 Sitts ..... E05C 17/38 16/223
2,586,757 A * 2/1952 Wummel ..... E05D 11/06 16/250
2,660,750 A * 12/1953 Wallen ..... E05D 11/06 16/223
2,976,563 A * 3/1961 Crisera ..... E05D 11/1014 16/333
3,206,793 A 9/1965 Silverberg
3,811,150 A * 5/1974 Chalmers ..... E05D 11/1007 16/352
3,913,171 A * 10/1975 Reid ..... E05D 11/06 16/342
3,918,121 A * 11/1975 Williams ..... E05D 11/1007 16/319
3,971,099 A * 7/1976 Wallace ..... E05D 11/06 16/50
3,971,100 A * 7/1976 Anop ..... E05C 19/184 16/375
4,738,002 A * 4/1988 Shank ..... E05D 11/06 16/223

(Continued)

FOREIGN PATENT DOCUMENTS

FR 2715428 A1 * 7/1995 ..... E05B 17/0025
GB 2198471 A * 6/1988 ..... E02D 29/1427

(Continued)

*Primary Examiner* — Jerry E Redman

(57) ABSTRACT

A portable door locking system includes a door that is hingedly positioned in a door jamb and the door includes a hinge. A locking unit is provided and the locking unit is selectively coupled to the hinge. The locking unit extends laterally between the door and the door jamb. In this way the door abuts the locking unit when the door is urged into an open position. The locking unit inhibits the door from being opened to inhibit an intruder from entering the room.

9 Claims, 4 Drawing Sheets

(56) References Cited

U.S. PATENT DOCUMENTS 5,265,922 A * 11/1993 Falcone ..... E05C 17/025 16/375
5,341,123 A * 8/1994 Schuman, Sr. ..... G08B 13/08 200/61.93
5,560,080 A * 10/1996 Reed ..... E05D 11/0018 16/374
5,642,910 A * 7/1997 Betherum ..... E05C 17/025 16/319
5,727,289 A 3/1998 Reder
5,881,431 A * 3/1999 Pieper, II ..... E05D 11/06 16/374
5,969,607 A * 10/1999 Cox ..... E05C 19/18 292/258
6,149,212 A * 11/2000 Kuntz ..... E05C 17/025 16/82
6,702,341 B1 * 3/2004 Hudelson ..... E05D 11/0018 292/288
6,778,086 B2 8/2004 Morrone et al.
RE42,991 E * 12/2011 Cook ..... G08B 23/00 340/539.1
D661,173 S 6/2012 Caffin et al.
8,863,561 B2 * 10/2014 Orlov ..... E05C 19/182 16/375
8,955,891 B2 * 2/2015 Millsap ..... E05C 17/025 16/82
9,493,973 B2 * 11/2016 Mitchell ..... E05D 7/0423
9,587,419 B1 * 3/2017 Turner ..... E05D 11/00
9,988,833 B2 * 6/2018 Powell ..... E05F 5/02
2008/0276421 A1 * 11/2008 Vanderpan ..... E05D 11/0054 16/250
2010/0275414 A1 * 11/2010 Stots ..... E05D 11/1007 16/342
2011/0018287 A1 * 1/2011 Wise ..... E05B 63/0008 292/288
2013/0104344 A1 * 5/2013 Lacy ..... E05D 5/14 16/374
2015/0008684 A1 * 1/2015 Ching ..... E05C 19/184 292/288

FOREIGN PATENT DOCUMENTS

WO WO-8802053 A1 * 3/1988 ..... E05C 19/184
WO WO2010127170 11/2010

* cited by examiner

PORTABLE DOOR LOCKING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to locking devices and more particularly pertains to a new locking device for selectively locking a door.

(2) Description of Related Art Including Information Disclosed Under 37 CFR 1.97 and 1.98

The prior art relates to locking devices.

BRIEF SUMMARY OF THE INVENTION

An embodiment of the disclosure meets the needs presented above by generally comprising a door that is hingedly positioned in a door jamb and the door includes a hinge. A locking unit is provided and the locking unit is selectively coupled to the hinge. The locking unit extends laterally between the door and the door jamb. In this way the door abuts the locking unit when the door is urged into an open position. The locking unit inhibits the door from being opened to inhibit an intruder from entering the room.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
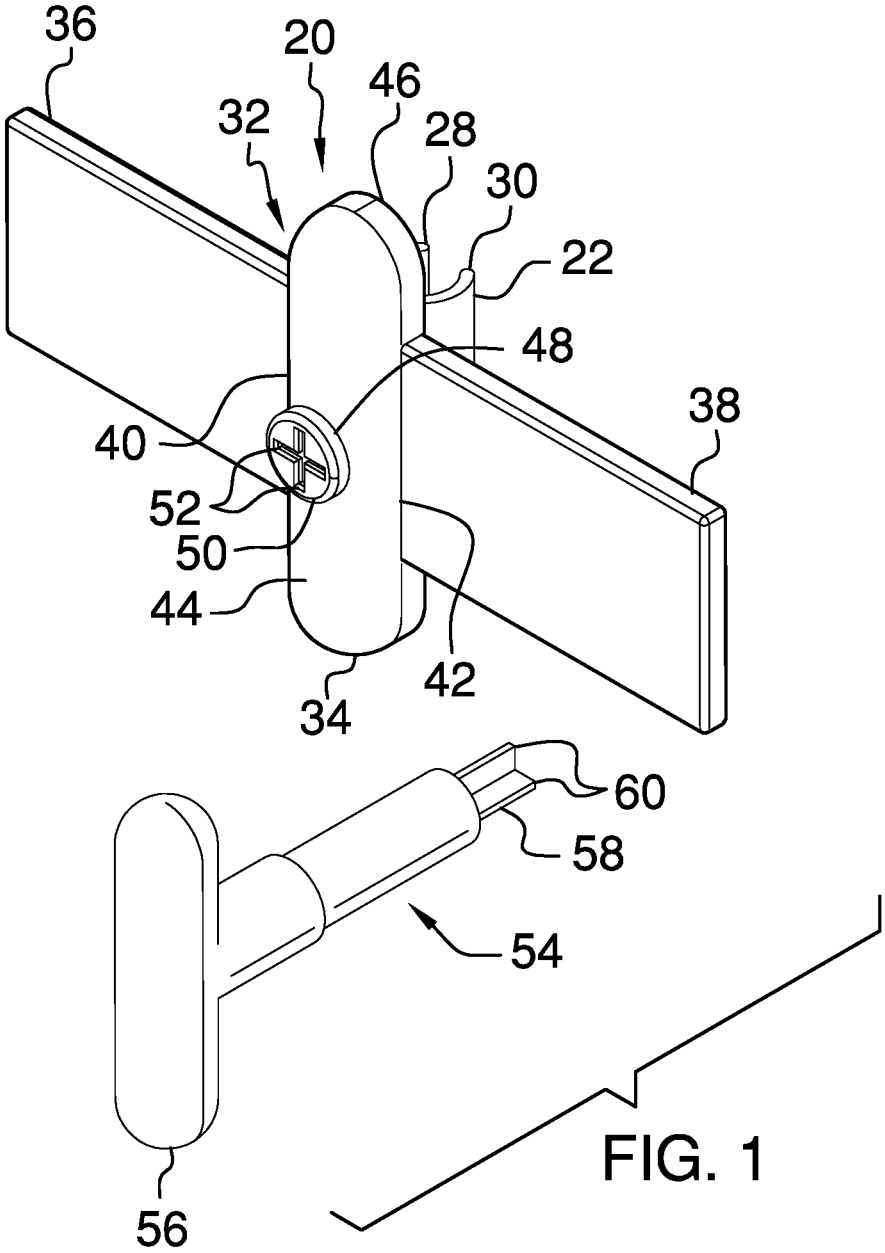
FIG. 1 is a perspective view of a locking unit and a key of a portable door locking system according to an embodiment of the disclosure.
Figure 2:
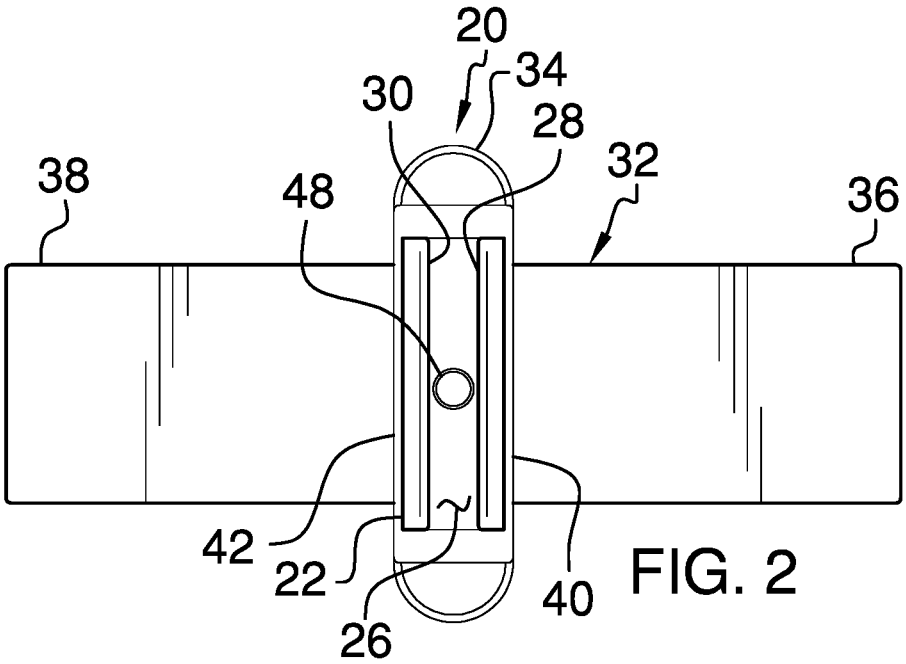
FIG. 2 is a back view of a locking unit of an embodiment of the disclosure.
Figure 3:
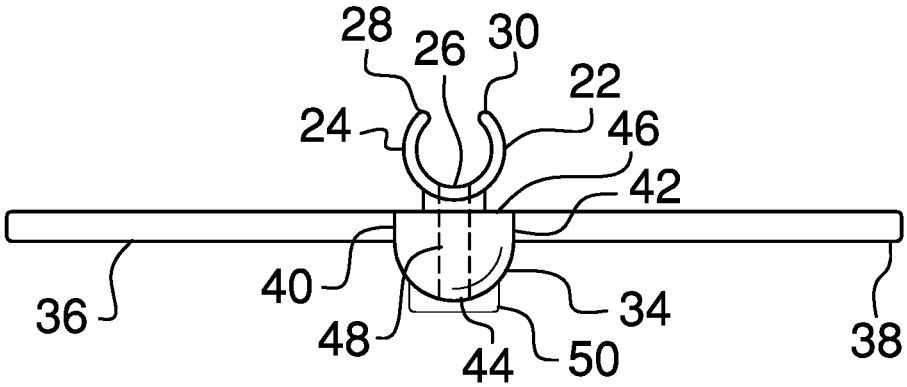
FIG. 3 is a top phantom view of a locking unit an embodiment of the disclosure.
Figure 4:
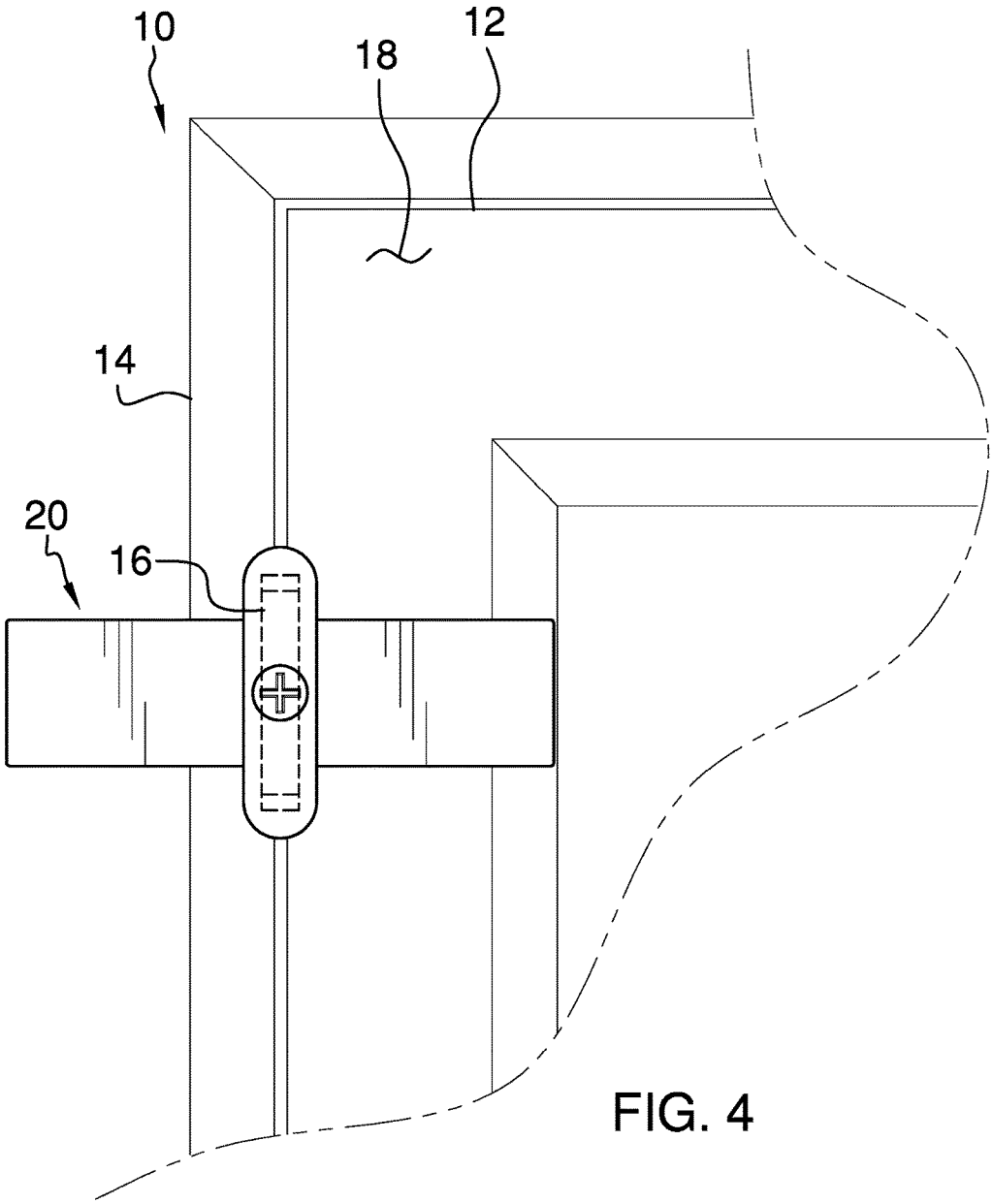
FIG. 4 is a perspective in-use view of an embodiment of the disclosure.

With reference now to the drawings, and in particular to FIGS. 1 through 5 thereof, a new locking device embodying the principles and concepts of an embodiment of the disclosure and generally designated by the reference numeral 10 will be described.

As best illustrated in FIGS. 1 through 5, the portable door locking system 10 generally comprises a door 12 is that is hingedly positioned in a door jamb 14. The door 12 has a hinge 16 and a first surface 18 and the first surface 18 faces into a room. The room may be a hotel room, a room in a residence or any other room used for sleeping or the like. The door 12 may be a hinged man door 12 of any conventional size and design. Additionally, the hinge 16 may be a door hinge or the like that has a cylindrical portion.

A locking unit 20 is provided and the locking unit 20 is selectively coupled to the hinge 16. The locking unit 20 extends laterally between the door 12 and the door jamb 14. The door 12 abuts the locking unit 20 when the door 12 is urged into an open position. In this way the locking unit 20 inhibits the door 12 from being opened to inhibit an intruder from entering the room.

The locking unit 20 comprises a saddle 22 that has a first surface 24, a second surface 26, a first end 28 and a second end 30. The saddle 22 is concavely arcuate between the first end 28 and the second end 30 such that the first end 28 is spaced from the second end 30. Each of the first end 28 and the second end 30 are biased toward each other. In this way the saddle 22 frictionally engages the hinge 16 having the second surface 26 of the saddle 22 abutting the hinge 16.

The locking unit 20 further includes a restraint 32 that has a central member 34, a first arm 36 and a second arm 38. The central member 34 has a first lateral side 40, a second lateral side 42, a front side 44 and a back side 46. The first surface 18 of the saddle 22 is positioned on the back side 46 of the central member 34. The first arm 36 extends outwardly from the first lateral side 40 and the second arm 38 extends outwardly from the second lateral side 42.

The first arm 36 abuts the door jamb 14 when the saddle 22 is positioned on the hinge 16. The second arm 38 abuts the first surface 18 of the door 12 when the saddle 22 is positioned on the hinge 16. The restraint 32 is comprised of a rigid material such as titanium or the like. Moreover, the restraint 32 has a bending strength that exceeds the amount of force that can be generated by a human being. In this way the restraint 32 resists being deformed when a human being attempts to urge the door 12 into the open position when the saddle 22 is positioned on the hinge 16.

A screw 48 extends through the central member 34 and rotatably engages the saddle 22. In this way the restraint 32 is rotatably coupled to the saddle 22. The screw 48 has a head 50 and the head 50 is exposed on the front side 44 of the central member 34. Moreover, the head 50 has a pair of slots 52 extending toward the saddle 22. The slots 52 are oriented perpendicular with each other such that the pair of slots 52 forms a plus.

A key 54 is provided and the key 54 is selectively manipulated. The key 54 has a handle 56 and a shaft 58. The shaft 58 has a pair of intersecting walls 60 such that the shaft 58 forms a plus corresponding to the slots 52 in the screw 48. The shaft 58 is selectively inserted into the slots 52 on the screw 48.

The key 54 selectively urges the restraint 32 into a locking position having each of the first arm 36 and the second arm 38 being horizontally oriented. In this way the first surface 18 of the door 12 engages the second arm 38 to inhibit the door 12 being opened. The key 54 selectively urges the restraint 32 into an unlocked position having each of the first arm 36 and the second arm 38 being vertically oriented. Thus, the second arm 38 does not engage the first surface 18 of the door 12 to facilitate the door 12 to be opened.

The locking unit 20 may include a processor, a transceiver, a motor and a power supply. The motor may be mechanically coupled to the screw 48 to selectively rotate the screw 48 thereby selectively urging the restraint 32 between the locking position and the unlocked position. In this way the restraint 32 may be remotely urged between the locking position and the unlocked position. The processor, the transceiver, the motor and the power supply may be in electrical communication with each other. Moreover, the transceiver may be in wireless electrical communication with a remote control.

Figure 5:
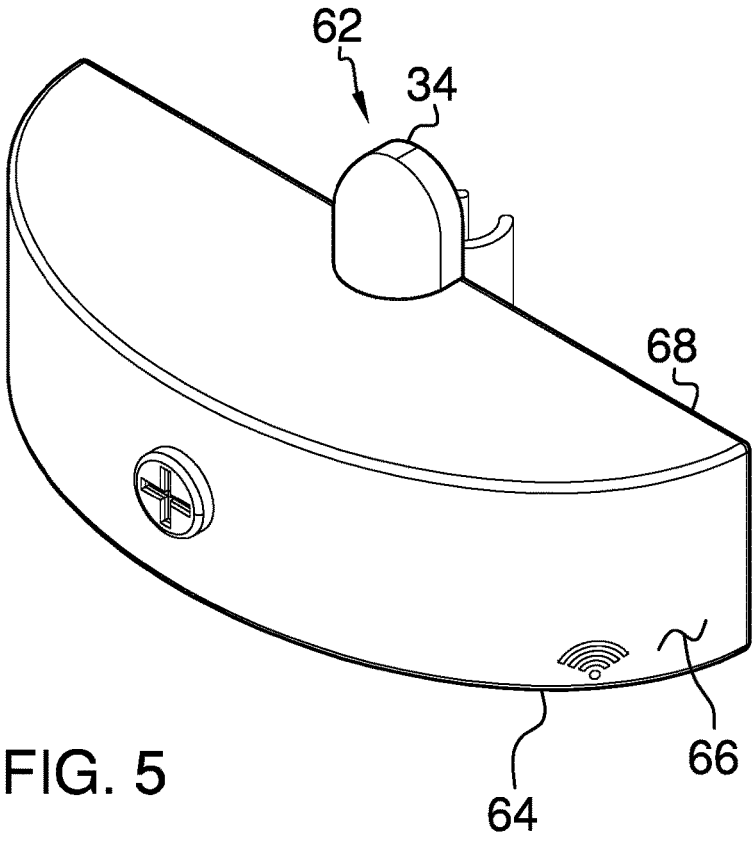
FIG. 5 is a perspective view of an alternative embodiment of the disclosure.

In an alternative embodiment 62 as shown in FIG. 5, a wedge 64 may be coupled to the central member 34. The wedge 64 may extend laterally beyond each of the first lateral side 40 and the second lateral side 42 of the central member 34. Additionally, the wedge 64 may have a primary surface 66 that may be concavely arcuate with respect to a secondary surface 68 such that the wedge 64 has a semi-circular shape.

In use, the saddle 22 is removably coupled to the hinge 16. The key 54 is selectively inserted into the slots 52 in the screw 48 and the screw 48 is rotated to position the restraint 32 into the locking position. Thus, the restraint 32 inhibits the door 12 from being opened thereby enhancing security of the room. The key 54 is selectively inserted into the slots 52 on the screw 48 and the screw 48 is rotated to position the restraint 32 into the unlocked position. In this way the restraint 32 facilitates the door 12 to be opened. The saddle 22 is removed from the hinge 16 at any selected time.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

The invention claimed is:

1. A portable door restraining system comprising:

a door being hingedly positioned in a door jamb, said door having a hinge and a first surface, said first surface facing into a room;

a locking unit being selectively coupled to said hinge, said locking unit extending laterally between said door and said door jamb such that said door abuts said locking unit when said door is urged into an open position, said locking unit inhibiting said door from being opened wherein said locking unit is configured to inhibit an intruder from entering said room, said locking unit comprising a restraint having a central member having a front side;

a saddle; and a screw extending through said central member and rotatably engaging said saddle such that said restraint is rotatably coupled to said saddle, said screw having a head, said head being exposed on said front side of said central member.

2. The system according to claim 1, wherein said saddle includes a first surface, a second surface, a first end and a second end, said saddle being concavely arcuate between said first end and said second end such that said first end is spaced from said second end thereby facilitating said saddle to removably engage said hinge.

3. The system according to claim 2, further comprising said restraint having a first arm and a second arm, said central member having a first lateral side, a second lateral side, and a back side, said first surface of said saddle being positioned on said back side of said central member.

4. The system according to claim 3, further comprising said first arm extending outwardly from said first lateral side, said second arm extending outwardly from said second lateral side, said first arm abutting said door jamb when said saddle is positioned on said hinge, said second arm abutting said first surface of said door when said saddle is positioned on said hinge.

5. The system according to claim 1, wherein said head has a pair of slots extending toward said saddle, said slots being oriented perpendicular with each other such that said pair of slots forms a plus.

6. The system according to claim 5, further comprising a key being configured to be manipulated, said key having a handle and a shaft, said shaft having a pair of intersection walls such that said shaft forms a plus corresponding to said slots in said screw.

7. The system according to claim 6, wherein:

said restraint having a first arm and a second arm; and said key selectively urges said restraint into a locking position having each of said first arm and said second arm being horizontally oriented such that said first surface of said door engages said second arm to inhibit said door being opened.

8. The system according to claim 7, wherein said key selectively urges said restraint into an unlocked position having each of said first arm and said second arm being vertically oriented such that said second arm does not engage said first surface of said door to facilitate said door to be opened.

9. A portable door locking system comprising:

a door being hingedly positioned in a door jamb, said door having a hinge and a first surface, said first surface facing into a room; and a locking unit being selectively coupled to said hinge, said locking unit extending laterally between said door and said door jamb such that said door abuts said locking unit when said door is urged into an open position, said locking unit inhibiting said door from being opened wherein said locking unit is configured to inhibit an intruder from entering said room, said locking unit comprising:

a saddle having a first surface, a second surface, a first end and a second end, said saddle being concavely arcuate between said first end and said second end such that said first end is spaced from said second end thereby facilitating said saddle to removably engage said hinge, a restraint having a central member, a first arm and a second arm, said central member having a first lateral side, a second lateral side, a front side and a back side, said first surface of said saddle being positioned on said back side of said central member, said first arm extending outwardly from said first lateral side, said second arm extending outwardly from said second lateral side, said first arm abutting said door jamb when said saddle is positioned on said hinge, said second arm abutting said first surface of said door when said saddle is positioned on said hinge, a screw extending through said central member and rotatably engaging said saddle such that said restraint is rotatably coupled to said saddle, said screw having a head, said head being exposed on said front side of said central member, said head having a pair of slots extending toward said saddle, said slots being oriented perpendicular with each other such that said pair of slots forms a plus, and a key being configured to be manipulated, said key having a handle and a shaft, said shaft having a pair of intersection walls such that said shaft forms a plus corresponding to said slots in said screw, said key selectively urging said restraint into a locking position having each of said first arm and said second arm being horizontally oriented such that said first surface of said door engages said second arm to inhibit said door being opened, said key selectively urging said restraint into an unlocked position having each of said first arm and said second arm being vertically oriented such that said second arm does not engage said first surface of said door to facilitate said door to be opened.

* * * * *